US008010272B2

(12) United States Patent
Kuwahara et al.

(10) Patent No.: US 8,010,272 B2
(45) Date of Patent: Aug. 30, 2011

(54) CONTROL DEVICE FOR INTERNAL COMBUSTION ENGINE

(75) Inventors: Seiji Kuwahara, Toyota (JP); Masato Kaigawa, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 807 days.

(21) Appl. No.: 12/083,549

(22) PCT Filed: Oct. 26, 2006

(86) PCT No.: PCT/JP2006/321935

§ 371 (c)(1),
(2), (4) Date: Apr. 14, 2008

(87) PCT Pub. No.: WO2007/055144

PCT Pub. Date: May 18, 2007

(65) Prior Publication Data

US 2009/0037066 A1 Feb. 5, 2009

(30) Foreign Application Priority Data

Nov. 8, 2005 (JP) ..... 2005-323568

(51) Int. Cl.
*F02D 45/00* (2006.01)
*F02D 41/04* (2006.01)

(52) U.S. Cl. ..... 701/84; 701/110; 123/350

(58) Field of Classification Search ..... 123/350, 123/349; 701/84, 110

See application file for complete search history.

(56) References Cited

U.S. PATENT DOCUMENTS

| | | | | |
|---|---|---|---|---|
| 5,101,786 | A * | 4/1992 | Kamio et al. | 123/399 |
| 5,662,084 | A | 9/1997 | Deguchi et al. | |
| 6,006,717 | A * | 12/1999 | Suzuki et al. | 123/295 |
| 6,155,230 | A * | 12/2000 | Iwano et al. | 123/406.24 |
| 6,904,357 | B2 * | 6/2005 | Hartmann et al. | 701/110 |
| 2002/0134351 | A1 * | 9/2002 | Birk et al. | 123/350 |
| 2004/0116220 | A1 * | 6/2004 | Yamamoto et al. | 474/18 |
| 2005/0009419 | A1 | 1/2005 | Kinoshita | |
| 2005/0051131 | A1 * | 3/2005 | Persson et al. | 123/350 |
| 2006/0102143 | A1 * | 5/2006 | Yagi | 123/350 |
| 2008/0066718 | A1 * | 3/2008 | Sato et al. | 123/350 |

FOREIGN PATENT DOCUMENTS

| | | |
|---|---|---|
| JP | A-03-237243 | 10/1991 |
| JP | A-09-032612 | 2/1997 |
| JP | A-2002-087117 | 3/2002 |
| JP | A-2004-360651 | 12/2004 |

* cited by examiner

*Primary Examiner* — Hieu T Vo
*Assistant Examiner* — Arnold Castro
(74) *Attorney, Agent, or Firm* — Oliff & Berridge, PLC

(57) ABSTRACT

A driving force control system includes an internal combustion engine model (1000) represented by a model linearized while including a first-order lag component, a calculator (2000) calculating deviation between target engine torque and estimated engine torque, a delay compensator (3000) compensating for response delay based on the deviation, and an adder (4000) calculating an engine controlled variable by adding delay-compensated deviation to the target engine torque.

22 Claims, 11 Drawing Sheets

CONTROL DEVICE FOR INTERNAL COMBUSTION ENGINE

TECHNICAL FIELD

The present invention relates to a control device for a vehicle including a powertrain having an engine and a transmission, and more particularly to a driving force control device (a control device for an internal combustion engine) capable of outputting driving force corresponding to driving force requested by a driver while realizing excellent control response characteristic and control stability.

BACKGROUND ART

With regard to a vehicle including an engine and an automatic transmission capable of controlling engine output torque independently of accelerator pedal operation by a driver, there is a concept of "driving force control" that positive and negative target drive torque calculated based on a degree of pressing the accelerator pedal by a driver, a vehicle operation condition and the like is achieved as engine torque and a gear ratio of the automatic transmission. Control schemes referred to as "driving force request type" and "driving force demand type" also belong to such a concept.

With this driving force control, target driving torque can be determined to easily change dynamic characteristics of the vehicle. Under acceleration/deceleration (transient response), however, not only inertia torque relevant to a change of the gear ratio of the automatic transmission with respect to time but also inertia torque relevant to a change of a wheel speed with respect to time causes the driving torque to deviate from the target value. Thus, the torque has to be corrected.

Further, in the case where how the gear ratio should be changed is determined based on a transmission map using a throttle position and a vehicle speed, the following problems arise. If the driving source of the vehicle is an engine, generated torque is increased as the throttle is opened to an increased degree. Therefore, in the case where the driver operates the vehicle to increase the requested driving force, the driving force can be increased in principle by increasing the degree to which the throttle is opened. However, the resultant characteristics are as follows. When the throttle is opened to a certain degree, the driving force generated from the engine is saturated, which means that even if the throttle is opened to a greater degree, the driving force is changed to only a small degree (driving force is not increased) (namely means that not the characteristics of a model but the characteristics of an actual object are not linear but non-linear). Therefore, in the state where a relatively great driving force is generated from the engine, if the driving force request is made to slightly increase the driving force, the throttle position is changed to a large degree. Thus, the throttle position is changed to a large degree so that the gear ratio is changed to cross the gear-change line on the transmission map. In this case, there is a deviation between the target driving torque and the generated torque and thus the vehicle behavior intended by the driver is not implemented.

Japanese Patent Laying-Open No. 2002-87117 discloses a driving force control device capable of achieving driving force as requested by a driver and thereby significantly improving power performance and drivability, with such control specifications that a steady target and a transient target of driving force are attained by tuned control of engine torque and gear ratio.

In a powertrain having an engine and a transmission, the driving force control device disclosed in this publication includes: accelerator pressing degree detection means for detecting a degree of pressing an accelerator; vehicle speed detection means for detecting a vehicle speed; target driving force operation means for operating static target driving force based on the detected degree of pressing the accelerator and vehicle speed; driving force pattern operation means for operating a pattern of variation in the target driving force; steady target value operation means for operating an engine torque steady target value based on the target driving force and operating a gear ratio steady target value based on the detected degree of pressing the accelerator and vehicle speed; transient target value operation means for operating an engine torque transient target value and a gear ratio transient target value based on the pattern of variation in the target driving force; target engine torque achieving means for achieving the engine torque steady target value and the engine torque transient target value; and target gear ratio achieving means for achieving the gear ratio steady target value and the gear ratio transient target value.

According to the driving force control device, during running, the target driving force operation means operates the static target driving force based on the degree of pressing the accelerator detected by the accelerator pressing degree detection means and the vehicle speed detected by the vehicle speed detection means, and the driving force pattern operation means operates the pattern of variation in the target driving force. In addition, the steady target value operation means operates the engine torque steady target value based on the target driving force and operates the gear ratio steady target value based on the detected degree of pressing the accelerator and vehicle speed. The transient target value operation means operates the engine torque transient target value and the gear ratio transient target value based on the pattern of variation in the target driving force. Then, the target engine torque achieving means achieves the engine torque steady target value and the engine torque transient target value, and the target gear ratio achieving means achieves the gear ratio steady target value and the gear ratio transient target value. Namely, control specifications are such that engine torque does not entirely compensate for generation of inertia torque involved with transmission delay of the transmission or variation in the revolution speed, but the steady target and the transient target of driving force are achieved by tuned control of the engine torque and the gear ratio. Therefore, driving force as requested by the driver can be achieved, and power performance and drivability can significantly be improved.

Here, in the engine or the automatic transmission mounted on the vehicle, as there is mechanical delay from issuance of a control instruction until an actual operation, the delay should be compensated for. Therefore, in Japanese Patent Laying-Open No. 2002-87117 as well, the target driving force is operated in such a manner that static target driving force is operated based on the degree of pressing the accelerator that represents the driver's operation and transient characteristics are calculated by adding delay in each component of the vehicle to the pattern of variation in the target driving force. Thus, the target driving force is calculated by associating manipulation by the driver and characteristics of each component of the vehicle (delay characteristics) with each other.

On the other hand, control response characteristic and control stability when delay compensation is made are exclusive to each other, and it is necessary to improve response characteristic while ensuring stability. In the driving force control device according to Japanese Patent Laying-Open No. 2002-87117 as well, there is room for improvement in response characteristic while further ensuring control stability.

DISCLOSURE OF THE INVENTION

The present invention was made to solve the above-described problems. An object of the present invention is to provide a driving force control device for a vehicle (a control device for an internal combustion engine) capable of achieving further improvement in control response characteristic and control stability in driving force control in the vehicle.

A control device according to the present invention controls each component in an internal combustion engine based on set target torque. The control device calculates estimated torque generated by the internal combustion engine, calculates deviation between the estimated torque and the target torque, calculates a torque controlled variable for which response delay has been compensated for, based on the calculated deviation, and controls each component by generating an instruction value to each component based on the calculated torque controlled variable.

According to the present invention, in torque demand control or the like, the torque controlled variable for controlling each component (actuator) in the internal combustion engine for realizing the target torque refers to a torque controlled variable calculated based on the deviation between the estimated torque and the target torque and a torque controlled variable for which response delay has been compensated for. As the response delay in the internal combustion engine is thus compensated for, response delay can be eliminated and control response characteristic can be improved. Consequently, a control device for an internal combustion engine, serving as a driving force control device for a vehicle, that is capable of achieving further improvement in control response characteristic in driving force control in the vehicle, can be provided.

Preferably, in calculating the estimated torque, the estimated torque is calculated by using a model equation formulated to include response delay in the internal combustion engine.

According to the present invention, for example, the estimated torque is calculated based on the torque controlled variable by using a model equation formulated to include response delay in the internal combustion engine (the model equation is preferably linear in terms of implementation). Thus, the estimated torque is calculated with the response delay being reflected thereon, and the torque controlled variable is calculated based on the deviation between the estimated torque and the target torque. Therefore, control response characteristic can be improved.

Further preferably, in calculating the torque controlled variable, the torque controlled variable is calculated by adding a value obtained as a result of operation of the calculated deviation and a coefficient to the target torque. The control device changes the coefficient based on an operation condition of the internal combustion engine.

According to the present invention, response delay is compensated for by calculating the torque controlled variable by adding a value obtained as a result of operation of the deviation and the coefficient (for example, deviation×coefficient) to the target torque. As response delay in the internal combustion engine fluctuates depending on an operation condition of the internal combustion engine (such as an engine speed or an intake air amount), the coefficient is changed depending on the operation condition. Thus, as the coefficient used for response delay compensation reflects the actual operation condition of the internal combustion engine, response delay can more properly be compensated for.

Further preferably, in changing the coefficient, the coefficient is changed to include a dead time in the internal combustion engine.

According to the present invention, a transfer function for the internal combustion engine may include a dead time component in addition to a response delay component. Therefore, the coefficient used for response delay compensation is calculated in consideration of not only response delay but also dead time. As such processing is performed, the dead time component can readily be compensated for. By taking into consideration the dead time component, overshoot (overshoot and undershoot) resulting from the dead time can be avoided and control stability can be improved. Consequently, a control device for an internal combustion engine, serving as a driving force control device for a vehicle, that is capable of achieving further improvement in control response characteristic and control stability in driving force control of the vehicle, can be provided.

Further preferably, in changing the coefficient, an operation condition of the internal combustion engine is estimated based on a dead time in the internal combustion engine and the coefficient is changed based on the estimated operation condition of the internal combustion engine.

According to the present invention, the condition of the internal combustion engine (the engine speed or the intake air amount) including delay for the dead time is estimated and the coefficient is changed by using the estimated engine speed and the estimated intake air amount. Thus, the dead time component can readily be compensated for.

Further preferably, in changing the coefficient, the coefficient is changed based on a speed and an intake air amount of the internal combustion engine.

According to the present invention, the coefficient can properly be changed based on the speed and the intake air amount that are important factors in the internal combustion engine, and control response characteristic and control stability can properly be improved.

Further preferably, the control device prohibits calculation of the torque controlled variable when the calculated deviation is within a predetermined range.

According to the present invention, if there is not great deviation, calculation of the controlled variable is prohibited and delay compensation is not reflected. By doing so, delay compensation control is not carried out for minor variation, and hunting of an electronic throttle valve or the like representing an actuator in the internal combustion engine can be avoided.

Further preferably, the control device calculates an amount of change in the target torque. When the calculated amount of change in the target torque is within a predetermined range, the control device prohibits calculation of the torque controlled variable.

According to the present invention, when the target torque has not varied greatly, calculation of the controlled variable is prohibited and delay compensation is not reflected. By doing so, delay compensation control is not carried out for minor variation, and hunting of an electronic throttle valve or the like representing an actuator in the internal combustion engine can be avoided.

Further preferably, the control device calculates an amount of change in the target torque. When increase in the target torque is reversed to decrease or vice versa and the amount of change in the target torque is within a predetermined range, the control device prohibits calculation of the torque controlled variable.

According to the present invention, if change in the target torque is not great even though increase in the target torque is reversed to decrease or vice versa, calculation of the controlled variable is prohibited and delay compensation is not reflected. By doing so, delay compensation control is not carried out for minor variation, and hunting of an electronic throttle valve or the like representing an actuator in the internal combustion engine can be avoided.

Further preferably, the control device holds the torque controlled variable calculated most recently when calculation of the torque controlled variable is prohibited.

According to the present invention, if change in the target torque is not great even though increase in the target torque is reversed to decrease or vice versa (abrupt change), calculation of the controlled variable is prohibited and the most recent controlled variable is held, and then delay compensation is made using that controlled variable. By doing so, delay compensation control is carried out while avoiding hunting. Therefore, control adapted more to abrupt change in the target torque, as compared with smoothing of the target torque, can be carried out.

BEST MODES FOR CARRYING OUT THE INVENTION

Figure 1:
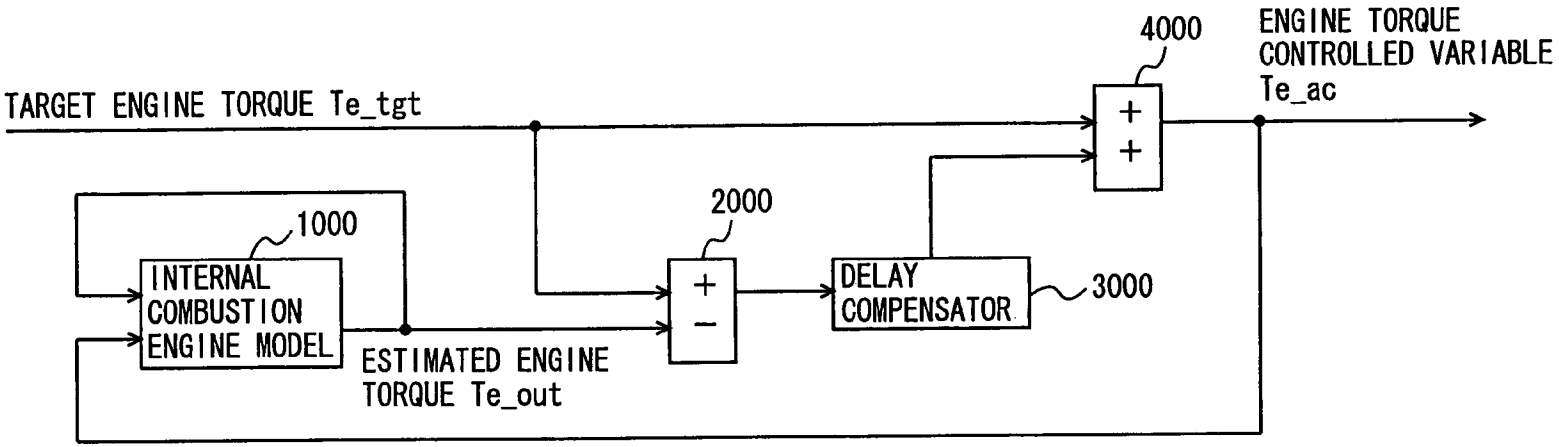
FIG. 1 is a control block diagram of a driving force control system according to a first embodiment of the present invention.

An embodiment of the present invention will be described hereinafter with reference to the drawings. In the description below, the same elements have the same reference characters allotted. Their label and function are also identical. Therefore, detailed description thereof will not be repeated. In the description below, an internal combustion engine is synonymous with an engine. In addition, it is assumed that a driving force control system includes a control device for an internal combustion engine (engine).

First Embodiment

The driving force control system according to the present embodiment aims to improve the response characteristic. In calculating an engine torque controlled variable for implementing target engine torque, the driving force control system calculates the target engine torque by compensating for response delay in control with respect to a difference between the estimated engine torque estimated from the target engine torque controlled variable and the target engine torque. Thus, the controlled variable for which response delay in control has accurately been compensated for can be calculated. Here, an internal combustion engine model used for calculating the estimated engine torque is assumed as a linear model without including a dead time, so that implementation on an ECU (Electronic Control Unit) is facilitated.

A control block diagram of the driving force control system according to the present embodiment will be described with reference to FIG. 1. It is noted that a transfer function for an internal combustion engine model 1000 does not include a dead time and response delay in control is expressed as first-order lag.

Internal combustion engine model 1000 receives input of estimated engine torque $Te_out_{i-1}$ of an immediately preceding cycle and engine torque controlled variable $Te_ac_{i-1}$ of the immediately preceding cycle, and estimated engine torque Te_out in a computation cycle is calculated as follows.

$$Te_out=(1-N)\cdot Te_out_{i-1}+N\cdot Te_ac_{i-1} \quad (1)$$

N in equation (1) represents a value associated with a time constant of first-order lag. A specific method of calculating N will be described later. It is noted that equation (1) is subjected to Z-transformation, taking into consideration implementation on the ECU. In addition, equation (1) is equivalent to the following equation.

$$Te_out=Te_out_{i-1}+N\cdot(Te_ac_{i-1}-Te_out_{i-1}) \quad (2)$$

Namely, estimated engine torque Te_out in the computation cycle is calculated by adding a value, obtained by multiplying deviation between engine torque controlled variable $Te_ac_{i-1}$ (in the immediately preceding cycle) and estimated engine torque $Te_out_{i-1}$ (in the immediately preceding cycle) by value N associated with the time constant of first-order lag, to estimated engine torque $Te_out_{i-1}$ calculated in the immediately preceding cycle.

Engine torque controlled variable Te_ac is defined as an output of an adder 4000. Inputs to adder 4000 are target engine torque Te_tgt and an output from a delay compensator 3000. An input to delay compensator 3000 is an output from a calculator 2000, and calculator 2000 calculates deviation between target engine torque Te_tgt and estimated engine torque Te_out. Therefore, delay compensator 3000 performs linear computation (computation for multiplication by 1/N, which is an inverse of value N associated with the time constant of first-order lag) and engine torque controlled variable Te_ac for which response delay in control has been compensated for is calculated with the following equation.

$$Te_ac=Te_tgt+1/N\cdot(Te_tgt-Te_out) \quad (3)$$

Here, as to value N associated with the time constant of the first-order lag, as the transfer function for the internal combustion engine (assumed as a first-order lag type herein) fluctuates depending on the engine speed or the intake air amount (and eventually on a fuel injection amount), these factors are represented as parameters in the present embodiment.

Figure 2:
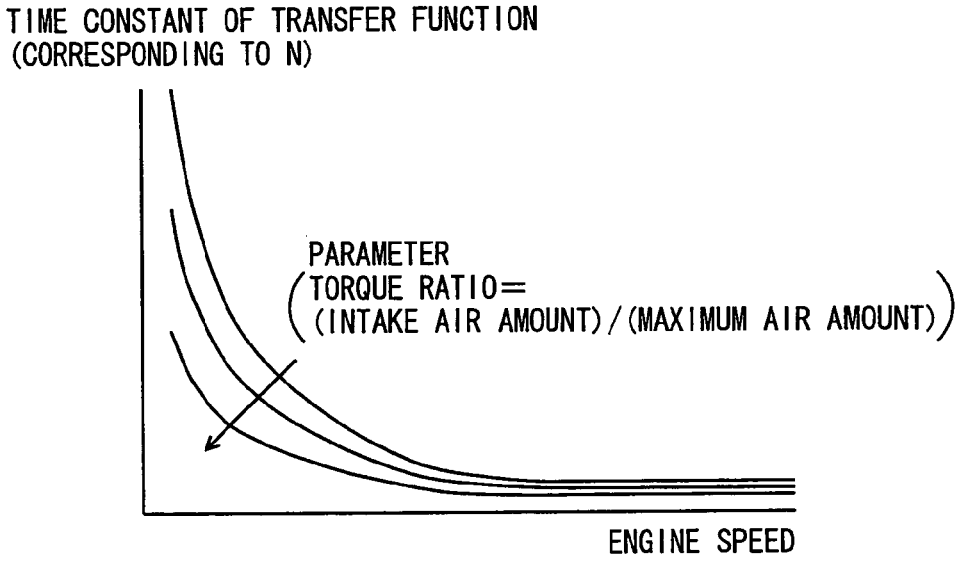
FIG. 2 illustrates relation between an engine speed and a time constant of a transfer function, with a torque ratio serving as a parameter.

For example, as shown in FIG. 2, the abscissa represents the engine speed and the torque ratio (=intake air amount/maximum air amount) is employed as the parameter, and FIG. 2 shows value N associated with the time constant of the transfer function (of a first-order lag type) in internal combustion engine model 1000.

As shown in FIG. 2, as the engine speed is lower, N is greater. In particular, in a low speed region, variation in N is great relative to variation in the engine speed (N significantly increases even though the speed only slightly lowers). Alternatively, as the engine speed is higher, N is smaller. In particular, in a high speed region, variation in N is small relative to variation in the engine speed (N does not significantly lower even though the speed increases).

An operation of the driving force control system according to the present embodiment based on the configuration above will be described with reference to FIGS. 3 and 4.

Figure 3:
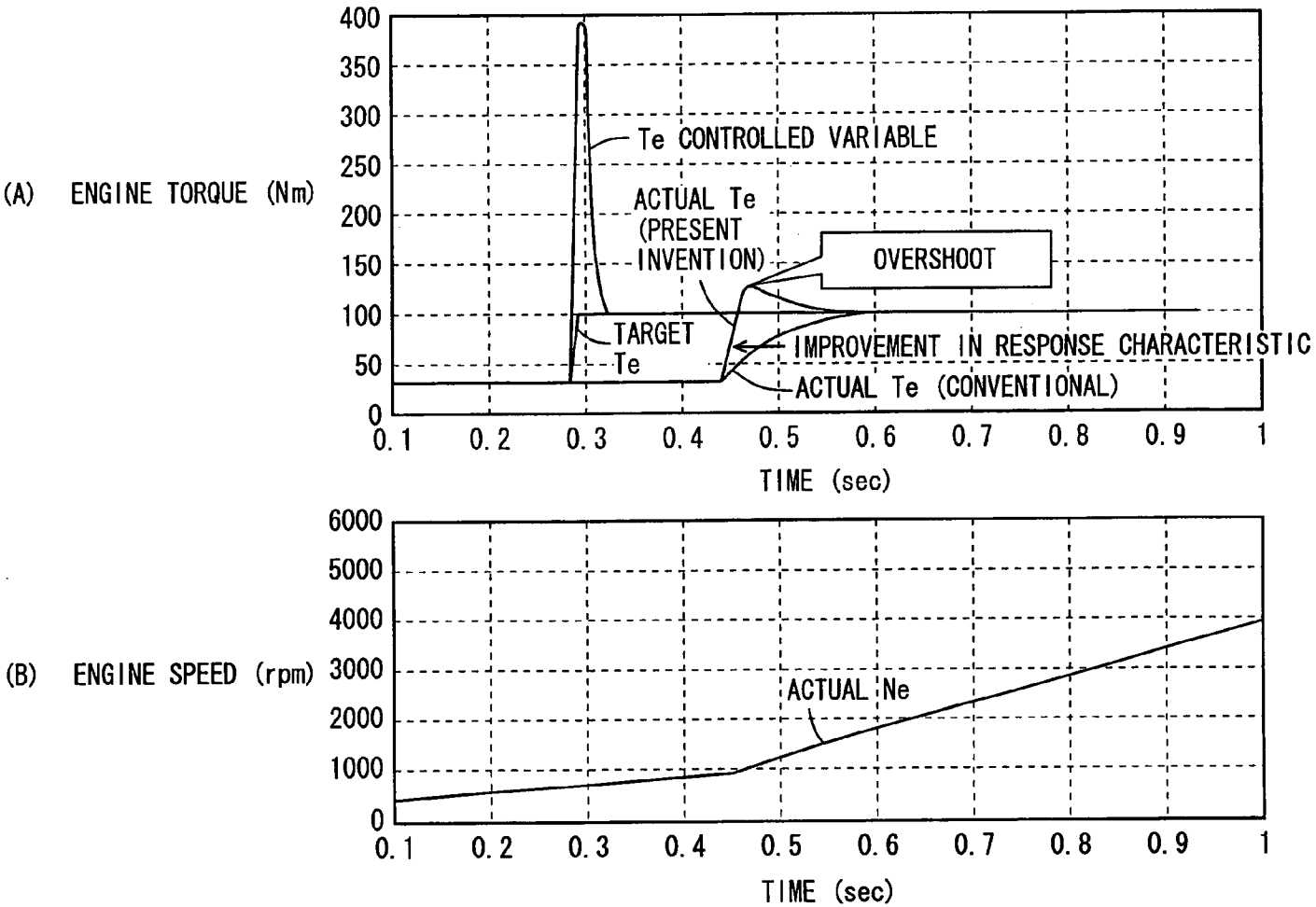
FIG. 3 illustrates response to step input in the driving force control system according to the first embodiment of the present invention.

FIG. 3 shows a response state when the target engine torque representing requested driving force is varied in a step manner in the driving force control system according to the present embodiment. The abscissa represents time, and the ordinates represent engine torque and an engine speed in FIGS. 3(A) and 3(B), respectively.

As shown in FIG. 3(A), when target engine torque Te_tgt (target Te in FIG. 3(A)) varies in a step manner, engine torque controlled variable Te_ac (Te controlled variable in FIG. 3(A)) is calculated based on equation (3). Here, N in equation (3) is calculated using the engine speed or the torque ratio (intake air amount) shown in FIG. 2 as a parameter.

Under conventional control without considering engine delay characteristics, response characteristic is not preferred as shown with "actual Te (conventional)" in FIG. 3(A). In the driving force control system according to the present embodiment, as shown with "actual Te (present invention)" in FIG. 3(A), response characteristic is improved. This is because engine torque controlled variable Te_ac is calculated with response delay in control being compensated for with respect to the difference between estimated engine torque Te_out estimated from target engine torque controlled variable Te_ac and target engine torque Te_tgt (multiplication by 1/N). On the other hand, as the dead time component in the internal combustion engine is not taken into consideration, overshoot occurs (overshoot in FIG. 3(A)).

As shown in FIG. 3(B), the engine speed (actual Ne) increases with the increase in engine torque actual Te (behind the step input).

Figure 4:
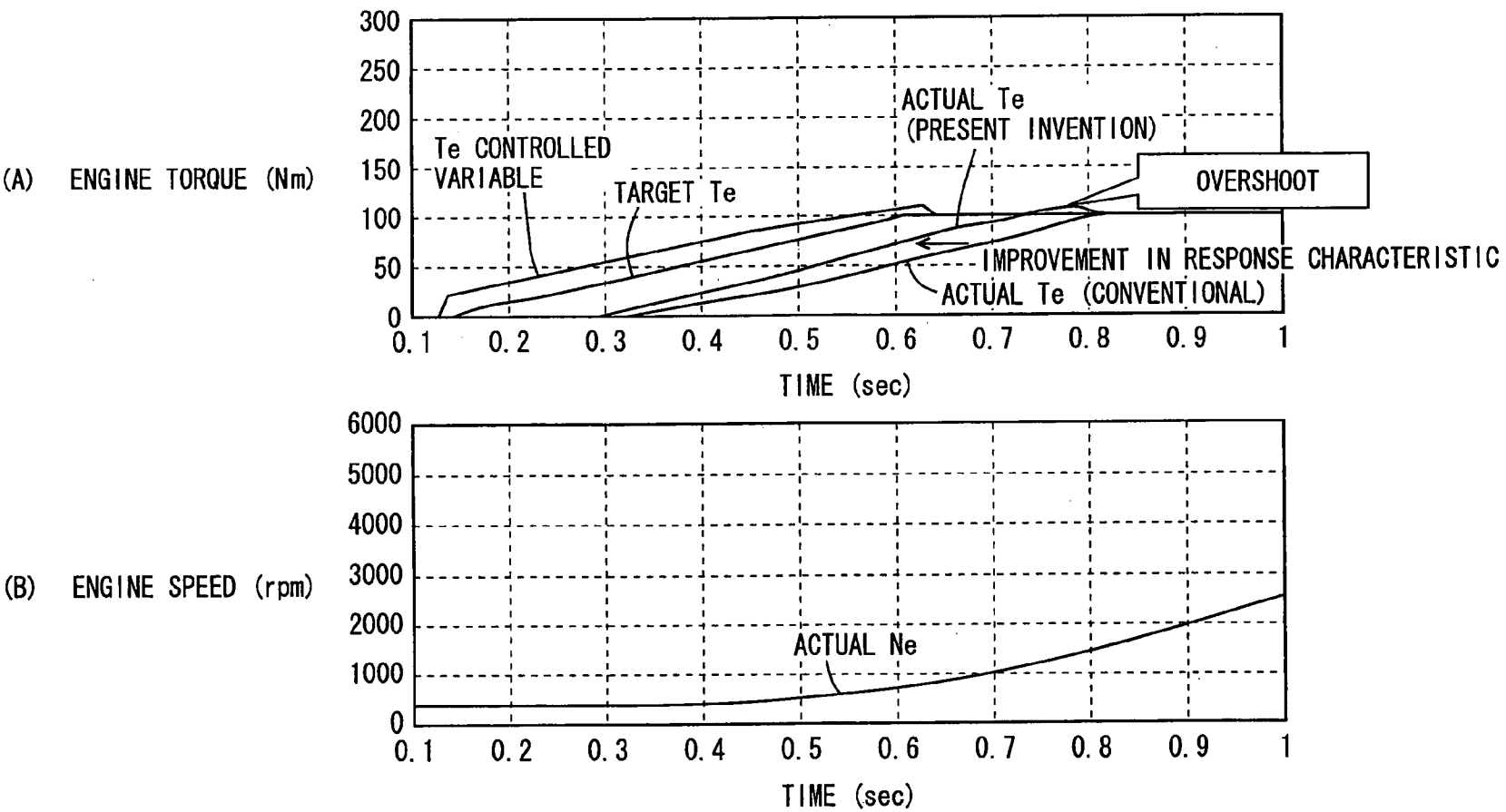
FIG. 4 illustrates response to ramp input in the driving force control system according to the first embodiment of the present invention.

FIG. 4 shows a response state when the target engine torque representing requested driving force is varied in a ramp manner in the driving force control system according to the present embodiment. The abscissa represents time, and the ordinates represent engine torque and an engine speed in FIGS. 4(A) and 4(B), respectively.

As shown in FIG. 4(A), when target engine torque Te_tgt (target Te in FIG. 4(A)) varies in a ramp manner, engine torque controlled variable Te_ac (Te controlled variable in FIG. 4(A)) is calculated based on equation (3). Here, N in equation (3) is calculated using the engine speed or the torque ratio (intake air amount) shown in FIG. 2 as a parameter.

Under conventional control without considering engine delay characteristics, response characteristic is not preferred as shown with "actual Te (conventional)" in FIG. 4(A). In the driving force control system according to the present embodiment, as shown with "actual Te (present invention)" in FIG. 4(A), response characteristic is improved. This is because, as in the step response, engine torque controlled variable Te_ac is calculated with response delay in control being compensated for with respect to the difference between estimated engine torque Te_out estimated from target engine torque controlled variable Te_ac and target engine torque Te_tgt (multiplication by 1/N). On the other hand, as the dead time component in the internal combustion engine is not taken into consideration, overshoot occurs (overshoot in FIG. 4(A)), although the extent thereof is small.

As shown in FIG. 4(B), the engine speed (actual Ne) increases with the increase in engine torque actual Te (behind the ramp input).

As described above, according to the driving force control system of the present embodiment, in order to compensate for response delay in a component mounted on a vehicle (specifically, the engine), an estimator of a control target (estimated engine torque) is calculated from the controlled variable (engine torque controlled variable) and response delay in control is compensated for with respect to the difference between the estimator and the target value (target engine torque). Consequently, the driving force control system in consideration of response delay in control can be provided.

Second Embodiment

A driving force control system according to the second embodiment of the present invention will be described hereinafter. The driving force control system according to the present embodiment aims to avoid occurrence of overshoot due to a dead time in the internal combustion engine. In the driving force control system according to the first embodiment described above, as the transfer function for the internal combustion engine includes the dead time component, the transfer function for the internal combustion engine at the time point of calculation of the engine torque controlled variable and the transfer function when the torque controlled variable is implemented are different from each other, and overshoot such as overflow and underflow occurs. Consequently, a behavior of the vehicle is disturbed.

Therefore, in the driving force control system according to the present embodiment, taking into consideration the dead time in the internal combustion engine, the transfer function calculated based on the estimated engine speed and the estimated intake air amount at the time point when the engine torque controlled variable is reflected (more specifically, the value of N in the first embodiment described above) is employed as the transfer function to be used for calculating the engine torque controlled variable.

Therefore, the driving force control system according to the present embodiment is the same as the driving force control system according to the first embodiment in the control block in FIG. 1, however, they are different in that the abscissa in FIG. 2 represents the estimated engine speed instead of the engine speed and the estimated intake air amount is employed as a parameter instead of the intake air amount. As the curve itself shown in FIG. 2 is applicable also to the driving force control system according to the present embodiment, description thereof will not be repeated.

In the following, a method of calculating the estimated engine speed and a method of calculating the estimated intake air amount, specific to the present embodiment, will be described.

Assuming that a dead time T has been calculated in advance from measurement results of an actual object, estimated engine speed Ne can be calculated as follows.

$$(A)\ \text{estimated engine speed } Ne = \text{current engine speed } Ne + \text{amount of change } \Delta Ne \text{ in current engine speed} \times \text{dead time } T \quad (4)$$

In addition, estimated engine speed Ne can be calculated as follows.

$$(B)\ \text{estimated engine speed } Ne = \text{amount of change } \Delta Ne \text{ in engine speed calculated from estimated engine torque } Te_out \times \text{dead time } T \quad (5)$$

Here, amount of change ΔNe in engine speed calculated from estimated engine torque Te_out can be calculated as follows, with Ie representing moment of inertia of the engine.

$$\text{angular acceleration } d\omega/dt = Te/Ie(\text{rad/sec}^2) \quad (6)$$

$$\Delta Ne = d\omega/dt \times 60/2\pi(\text{rpm/sec}) \quad (7)$$

Moreover, estimated engine speed Ne can be calculated as follows.

$$(C)\ \text{estimated engine speed } Ne = \text{current engine speed } Ne + \text{constant value} \quad (8)$$

If engine speed Ne is calculated as in (C) by estimating the same to be relatively high, response characteristic of the internal combustion engine itself is improved as the engine speed is higher (see FIG. 2). Therefore, it is safer if relatively high estimated engine speed is calculated by thus adding the constant value.

(D) Further, although limited to a vehicle including a torque converter (naturally, in a vehicle including an automatic transmission, a torque converter is included as a fluid coupling in many cases), estimated engine speed Ne may be calculated also by using a static balance point of the torque converter.

Using current turbine speed Nt and estimated engine torque Te_out, a point where engine speed Ne will be balanced in the future is calculated in advance, which is in turn calculated as estimated engine speed Ne.

Similar calculation can be made also by using estimated turbine speed Nt calculated as in (A) to (C) instead of current turbine speed Nt and by using target engine torque Te_tgt instead of estimated engine torque Te_out.

(E) As in (C) above, as the engine speed is higher, response characteristic of the internal combustion engine itself is improved. Therefore, the lower limit of estimated engine speed Ne is set to current engine speed Ne as a guard (such that estimated engine speed Ne is not lower than current engine speed Ne), so that response characteristic is enhanced and overshoot or undershoot can be lessened.

The estimated intake air amount is calculated as follows.

A map of an intake air amount calculated based on torque and a revolution speed is created based on data of the actual object, and referring to the map of the intake air amount, the estimated intake air amount is calculated based on target engine torque Te_tgt or estimated engine torque Te_out and estimated engine speed Ne.

As the estimated engine speed and the estimated intake air amount can be calculated as described above, the value of N for taking into consideration the dead time in the internal combustion engine is calculated based on the map shown in FIG. 2. Here, the calculated value of N is a value in consideration of the dead time in the internal combustion engine, because at least the estimated engine speed has been calculated in consideration of dead time T.

An operation of the driving force control system according to the present embodiment based on the configuration above will be described with reference to FIGS. 5 and 6.

Figure 5:
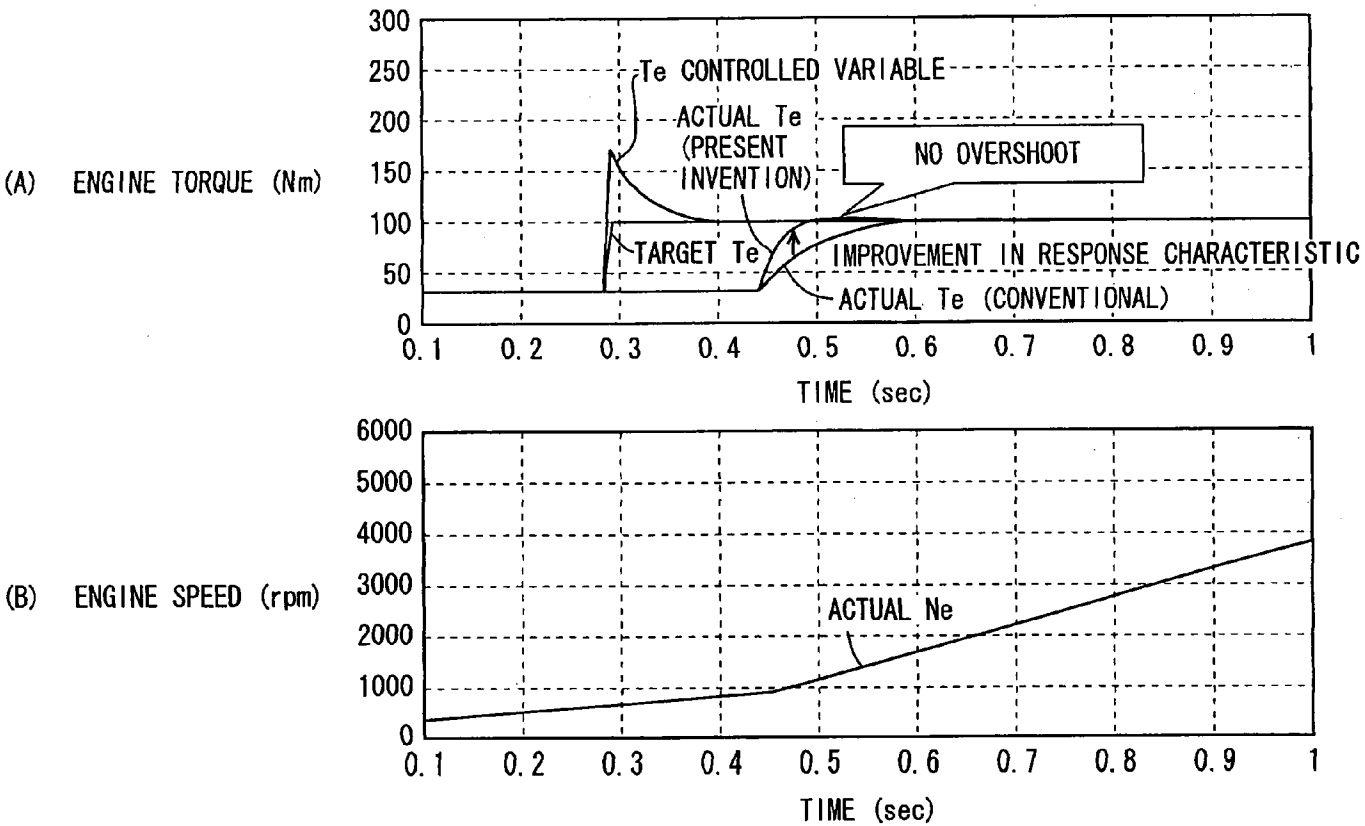
FIG. 5 illustrates response to step input in a driving force control system according to a second embodiment of the present invention.

FIG. 5 shows a response state when the target engine torque representing requested driving force is varied in a step manner in the driving force control system according to the present embodiment. The abscissa represents time, and the ordinates represent engine torque and an engine speed in FIGS. 5(A) and 5(B), respectively.

When target engine torque Te_tgt (target Te in FIG. 5(A)) varies in a step manner as shown in FIG. 5(A), engine torque controlled variable Te_ac (Te controlled variable in FIG. 5(A)) is calculated by using value N associated with the time constant of the transfer function calculated by substituting the estimated engine speed and the estimated intake air amount in the map shown in FIG. 2 (equation (3)). Under conventional control without considering engine delay characteristics and the dead time, response characteristic is not preferred as shown with actual Te (conventional) in FIG. 5(A). Here, actual Te (conventional) in FIG. 5(A) is the same as actual Te (conventional) in FIG. 3(A). In the driving force control system according to the present embodiment, as shown with actual Te (present invention) in FIG. 5(A), response characteristic is improved and overshoot does not occur. This is because engine torque controlled variable Te_ac is calculated with response delay in control being compensated for with respect to the difference between estimated engine torque Te_out estimated from target engine torque controlled variable Te_ac and target engine torque Te_tgt (multiplication by 1/N) (the first embodiment) and because the dead time is taken into consideration. The dead time is taken into consideration by calculating the estimated engine speed and the estimated intake air amount in consideration of the dead time, and by calculating, using these estimated engine speed and estimated intake air amount, value N associated with the time constant of the transfer function from FIG. 2.

As shown in FIG. 5(B), the engine speed (actual Ne) increases with the increase in the engine torque (actual Te) (behind step variation).

Figure 6:
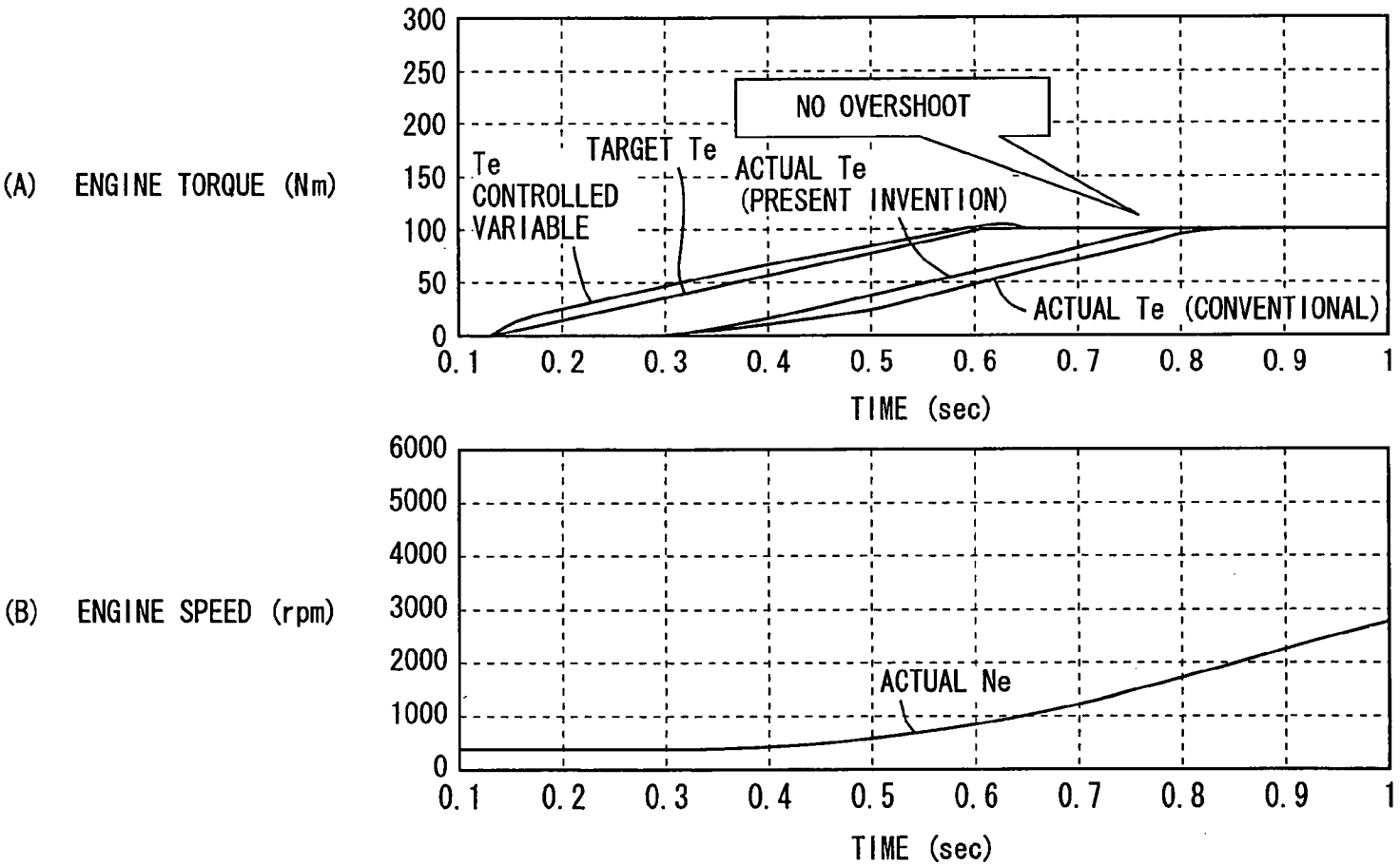
FIG. 6 illustrates response to ramp input in the driving force control system according to the second embodiment of the present invention.

FIG. 6 shows a response state when the target engine torque representing requested driving force is varied in a ramp manner in the driving force control system according to the present embodiment. The abscissa represents time, and the ordinates represent engine torque and an engine speed in FIGS. 6(A) and 6(B), respectively.

When target engine torque Te_tgt (target Te in FIG. 6(A)) varies in a ramp manner as shown in FIG. 6(A), engine torque controlled variable Te_ac (Te controlled variable in FIG. 6(A)) is calculated by using value N associated with the time constant of the transfer function calculated by substituting the estimated engine speed and the estimated intake air amount in the map shown in FIG. 2 (equation (3)). Under conventional control without considering engine delay characteristics and the dead time, response characteristic is not preferred as shown with "actual Te (conventional)" in FIG. 6(A). Here, actual Te (conventional) in FIG. 6(A) is the same as actual Te (conventional) in FIG. 4(A). In the driving force control system according to the present embodiment, as shown with actual Te (present invention) in FIG. 6(A), response characteristic is improved. This is because, as in step response, engine torque controlled variable Te_ac is calculated with response delay in control being compensated for with respect to the difference between estimated engine torque Te_out estimated from target engine torque controlled variable Te_ac and target engine torque Te_tgt (multiplication by 1/N) (the first embodiment) and because the dead time is taken into consideration. The dead time is taken into consideration by calculating the estimated engine speed and the estimated intake air amount in consideration of the dead time, and by calculating, using these estimated engine speed and estimated intake air amount, value N associated with the time constant of the transfer function from FIG. 2.

As shown in FIG. 6(B), the engine speed (actual Ne) increases with the increase in the engine torque (actual Te) (behind the ramp input).

As described above, according to the driving force control system of the present embodiment, as shown in the first embodiment, an estimator of a control target (estimated engine torque) is calculated from the controlled variable (engine torque controlled variable) and response delay in control is compensated for with respect to the difference between the estimator and the target value (target engine torque), and here, a coefficient for compensating for the response delay is calculated in consideration of the dead time. Consequently, the driving force control system in consideration of not only response delay in control but also the dead time component can be provided.

Other Response Examples

Figure 7:
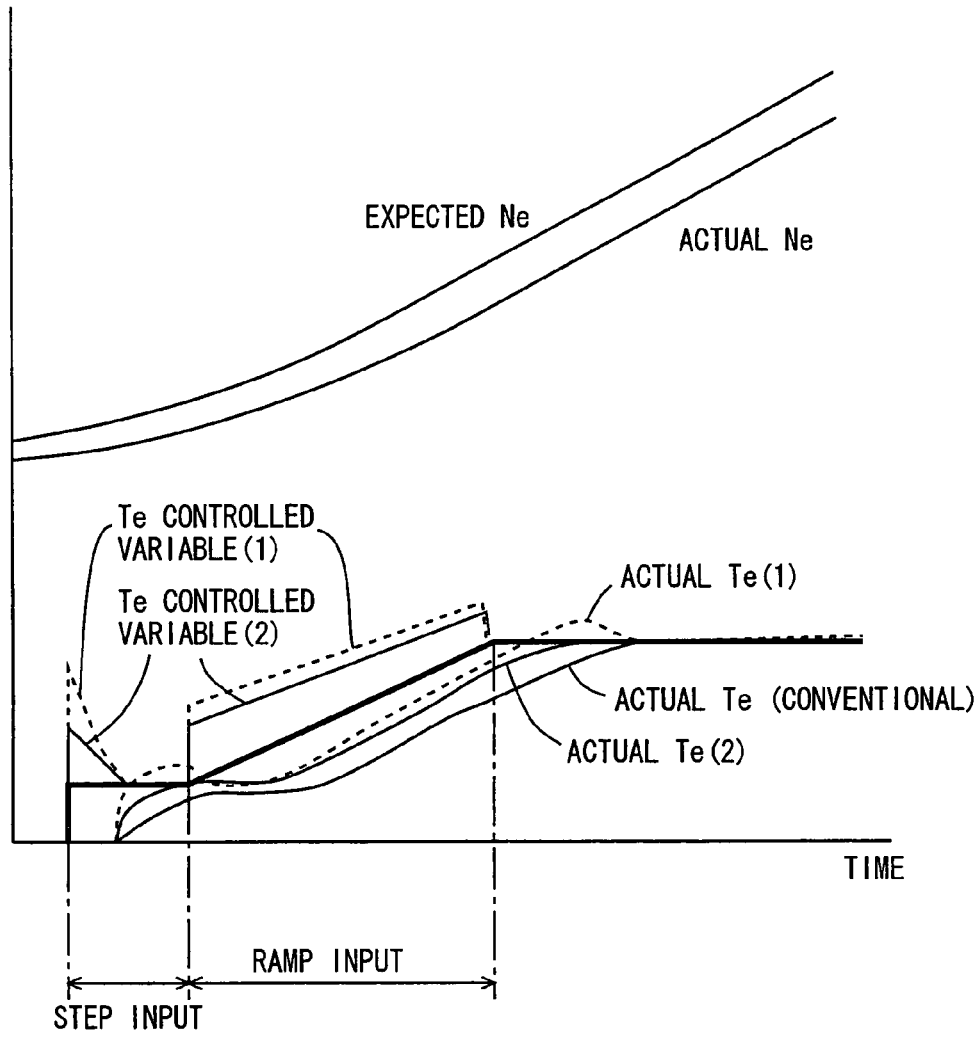
FIG. 7 illustrates response to step input and ramp input in the driving force control systems according to the first and second embodiments of the present invention.

FIG. 7 illustrates an example of response when ramp input is made after step input in the driving force control system according to the first embodiment and the driving force control system according to the second embodiment.

In FIG. 7, Te controlled variable (1) and actual Te (1) correspond to the driving force control system according to the first embodiment (in consideration of the delay time in control), while Te controlled variable (2) and actual Te (2) correspond to the driving force control system according to the second embodiment (in consideration of the delay time in control and the dead time).

In any of the step response and the ramp response, according to the driving force control system in the first embodiment, it can be seen that actual Te (conventional) attains to actual Te (1) and response characteristic is improved, however, overshoot occurs and control stability is poor. According to the driving force control system in the second embodiment, it can be seen that actual Te (conventional) attains to actual Te (2) and response characteristic is improved as well as overshoot is avoided and control stability is improved.

As described above, the delay component and the dead time component included in the transfer function for the component mounted on the vehicle are compensated for, so that the driving force control system having excellent control response characteristic and control stability can be provided.

Third Embodiment

In the embodiments described above, delay compensation, or dead time compensation in addition to delay compensation is performed. Namely, such compensation is made (compensation is made to raise a controlled variable by multiplying deviation between an estimated actual output value and a target value by gain, allowing for delay and dead time). If such compensation is unexceptionally made for slight variation in the target value, hunting of an actuator (such as an electronic throttle valve adjusting an intake air amount) occurs and durability may be lowered. In particular, even when feedback control is being carried out and a stable state is attained (basically when there is no change in driving force requested by a driver or a vehicle control system (such as cruise control)), the target value calculated through operation is constantly varied. Normally, such fluctuation is minor and response characteristic thereto does not give rise to a problem. Therefore, in the present embodiment, delay compensation adapted to such minor variation is made.

In the driving force control system according to the present embodiment, (1) delay compensation control for minor variation in the target value is not carried out, and (2) hunting itself is avoided by making modification for accommodating (only) minor variation in the target value.

In the following, description will be given for each of the above.

(1) Sensing of minor variation in the target value

The following two methods are available as the method of sensing minor variation.

(1-1) If difference (deviation) between the target value (target engine torque Te_tgt) and estimated actual output (estimated engine torque Te_out) is within a predetermined range, the fact of minor variation is sensed.

Figure 8:
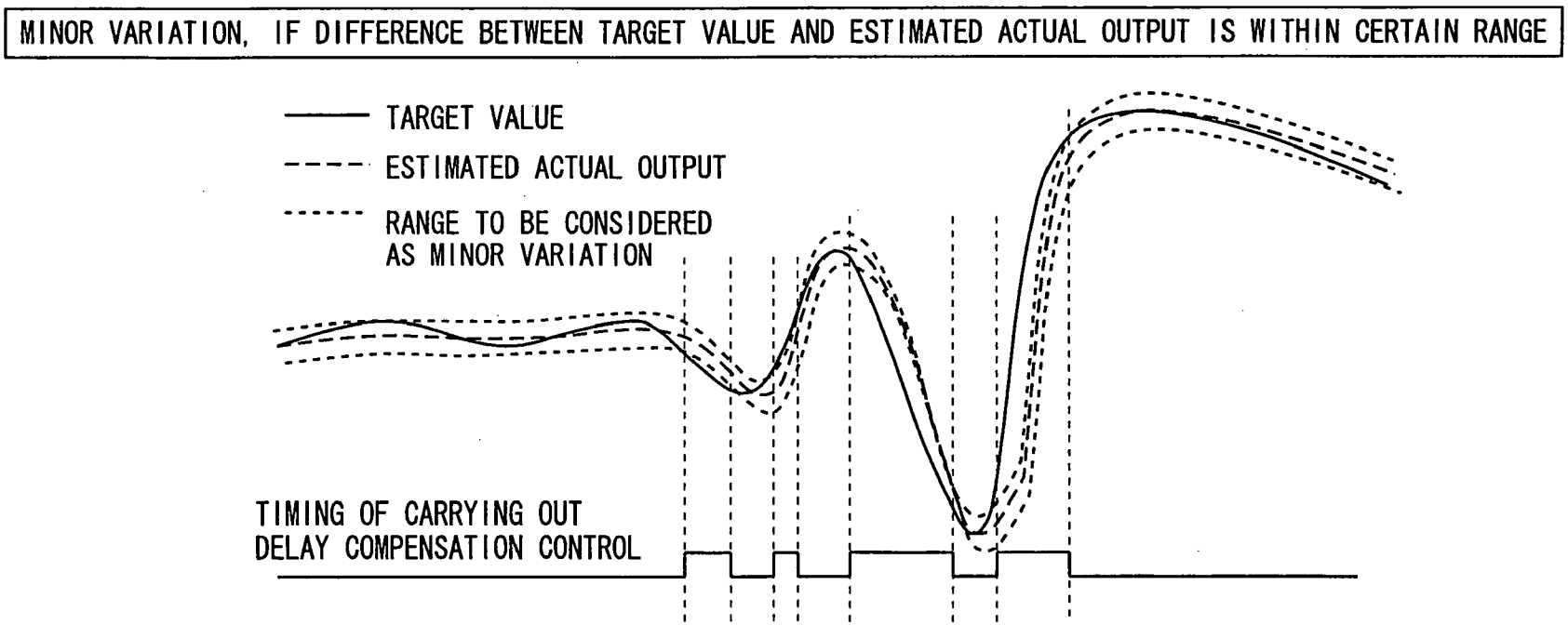
FIGS. 8 to 10 illustrate sensing of minor variation in a driving force control system according to a third embodiment of the present invention.

Specifically, as shown in FIG. 8, ΔTe=|target value (target engine torque Te_tgt)−estimated actual output (estimated engine torque Te_out)| is calculated, and if this deviation is within a predetermined range (namely without deviating from the "range to be considered as minor variation" in FIG. 8), determination as minor variation is made.

By doing so, only when deviation ΔTe is out of the "range to be considered as minor variation" in FIG. 8 (determination that delay compensation control is necessary is made), delay compensation control is executed. The timing when delay compensation control is executed is represented as the "timing of carrying out delay compensation control" in FIG. 8.

The configuration may be such that, when variation in the target value (target engine torque Te_tgt) is within a predetermined range, the fact of minor variation may be sensed.

(1-2) When variation in the target value (target engine torque Te_tgt) from increase to decrease or vice versa is sensed and when such variation is within a predetermined range, the fact of minor variation is sensed.

Figure 9:
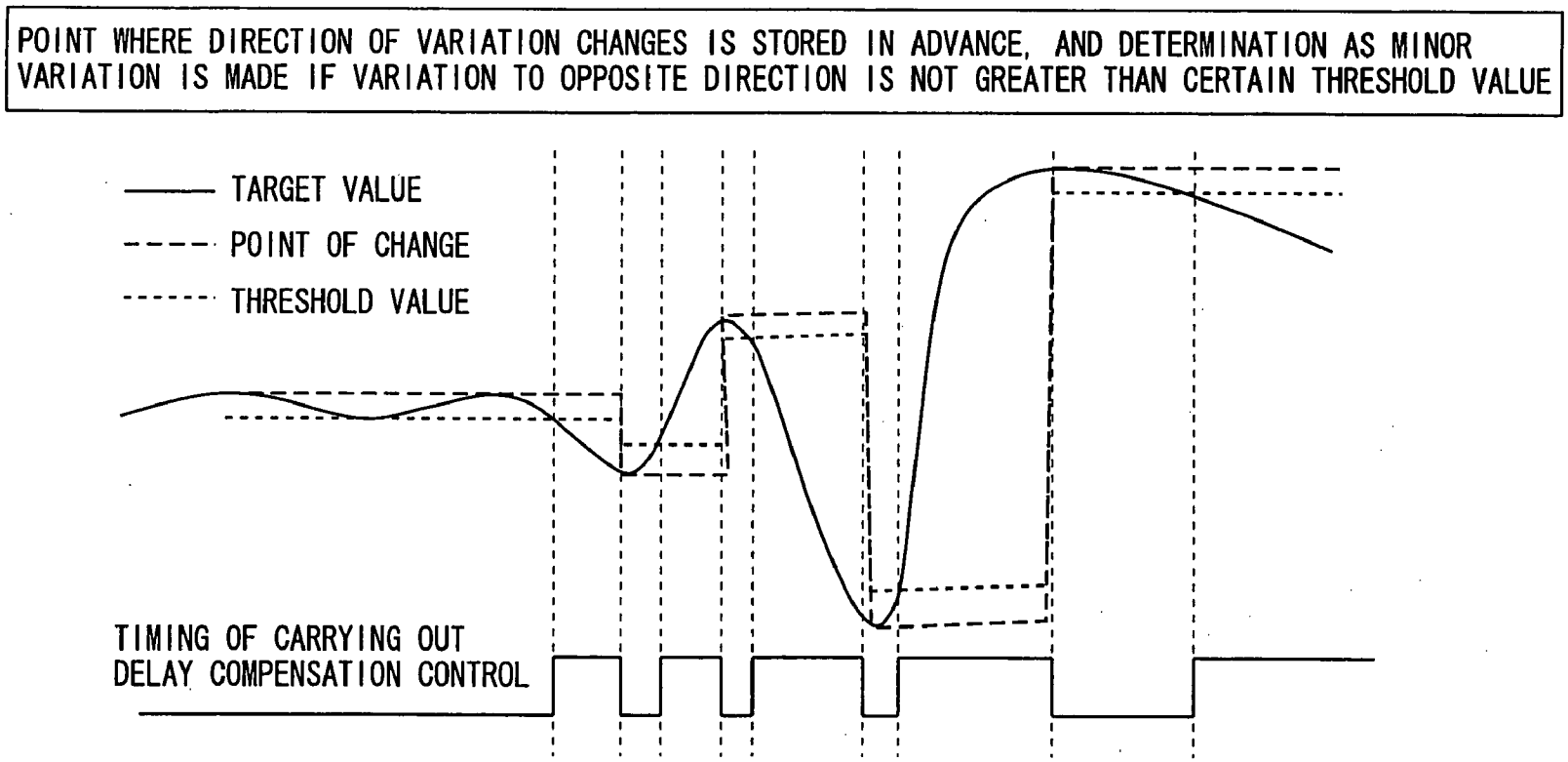

Specifically, as shown in FIG. 9, dTe/dT (time-differential value of the target value) is calculated, and when the sign of the time-differential value changes (from + to − or from − to +) and when the differential value (amount of change) is within a predetermined range (that is, without deviating from the "threshold value" in FIG. 9), determination as minor variation is made.

By doing so, even though the sign of time-differential value dTe/dt changes (from + to − or from − to +), delay compensation control is executed only when the time-differential value (amount of change) deviates from the "threshold value" in FIG. 9 (determination that delay compensation control is necessary is made). The timing when delay compensation control is executed is represented as the "timing of carrying out delay compensation control" in FIG. 9.

(2) Avoiding hunting itself by making modification for accommodating minor variation in the target value When variation in the target value (target engine torque Te_tgt) from increase to decrease or vice versa is sensed and when such variation is within a predetermined range, a dead zone for such variation is provided. More specifically, the dead zone herein refers to a feature that, in calculating a modified target value obtained by modifying the target value, the modified target value is not allowed to follow variation in the target value if a predetermined condition (variation in the target value from increase to decrease or vice versa) is satisfied. Namely, even when variation in the target value from increase to decrease or vice versa is caused, the modified target value is not permitted to reflect thereon such variation in the target value.

Figure 10:
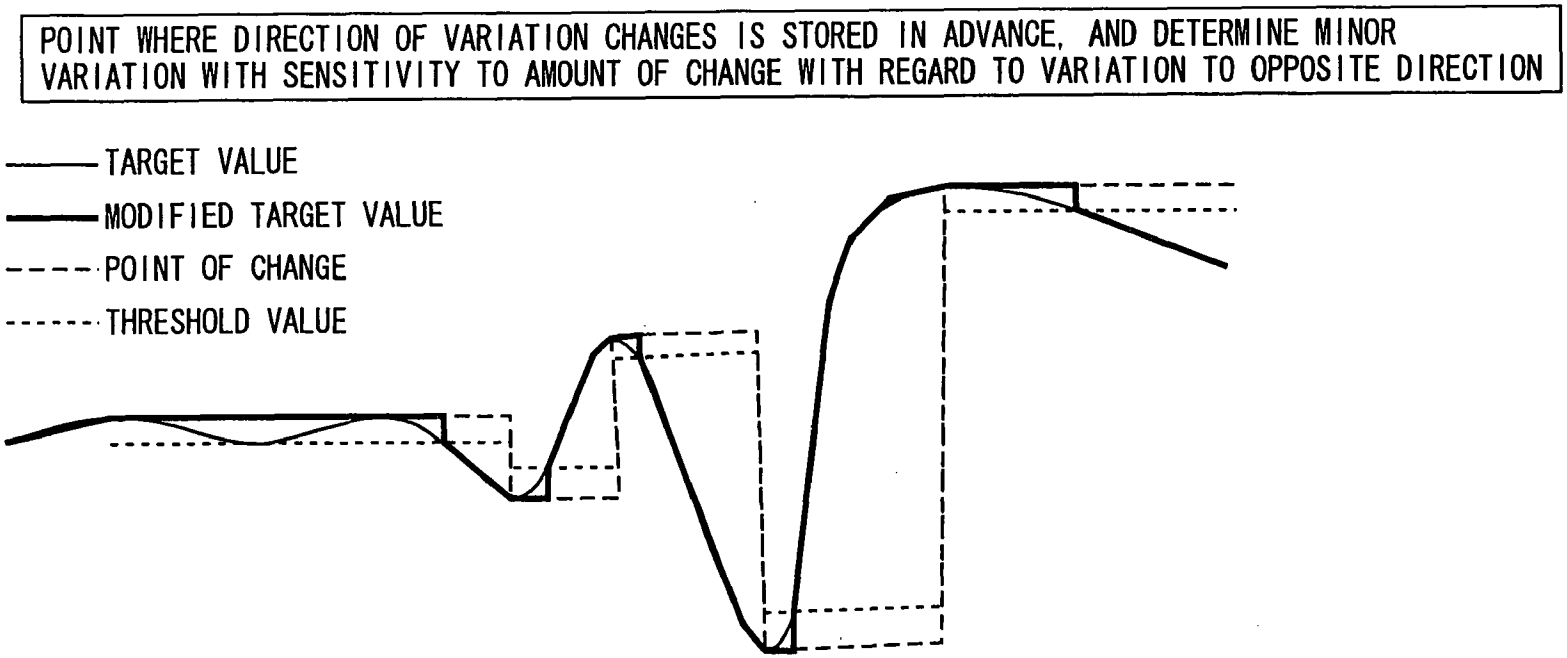

Specifically, as shown in FIG. 10, dTe/dT (time-differential value of the target value) is calculated, and when the sign of the time-differential value changes (from + to − or from − to +), the modified target value holds the most recent value, despite variation in the target value, for a predetermined time period after sensing of the variation (until the target value exceeds the threshold value).

By doing so, even when the sign of time-differential value dTe/dt changes (from + to − or from − to +), variation is not reflected on the modified target value immediately, and the dead zone where the modified target value is not allowed to follow the target value until the target value exceeds the threshold value is formed. When the target value exceeds the "threshold value" in FIG. 10 (determination that hunting of the actuator can be avoided even if the modified target value is allowed to follow the target value is made), the modified target value is allowed to follow the target value and delay compensation control is executed.

When the target value suddenly changes (the sign of a time-varying ratio of the target value is reversed) and when that target value is used as it is without providing the dead zone for sudden change in the target value, the operation of the actuator suddenly changes and hunting occurs. Here, by providing the dead zone, even when the sign of the time-varying ratio of the target value is reversed, the most recent target value (most recent before the sign of the time-varying ratio of the target value is reversed) is held as the modified target value, without allowing reflection on a control signal to the actuator. Consequently, hunting of the actuator can be avoided. In addition, though the dead zone is provided, reflection of sudden change in the target value is simply prohibited (delay control itself is carried out by using the most recent target value). Therefore, sudden change in the target value is not smoothened and delay compensation is carried out.

Figure 11:
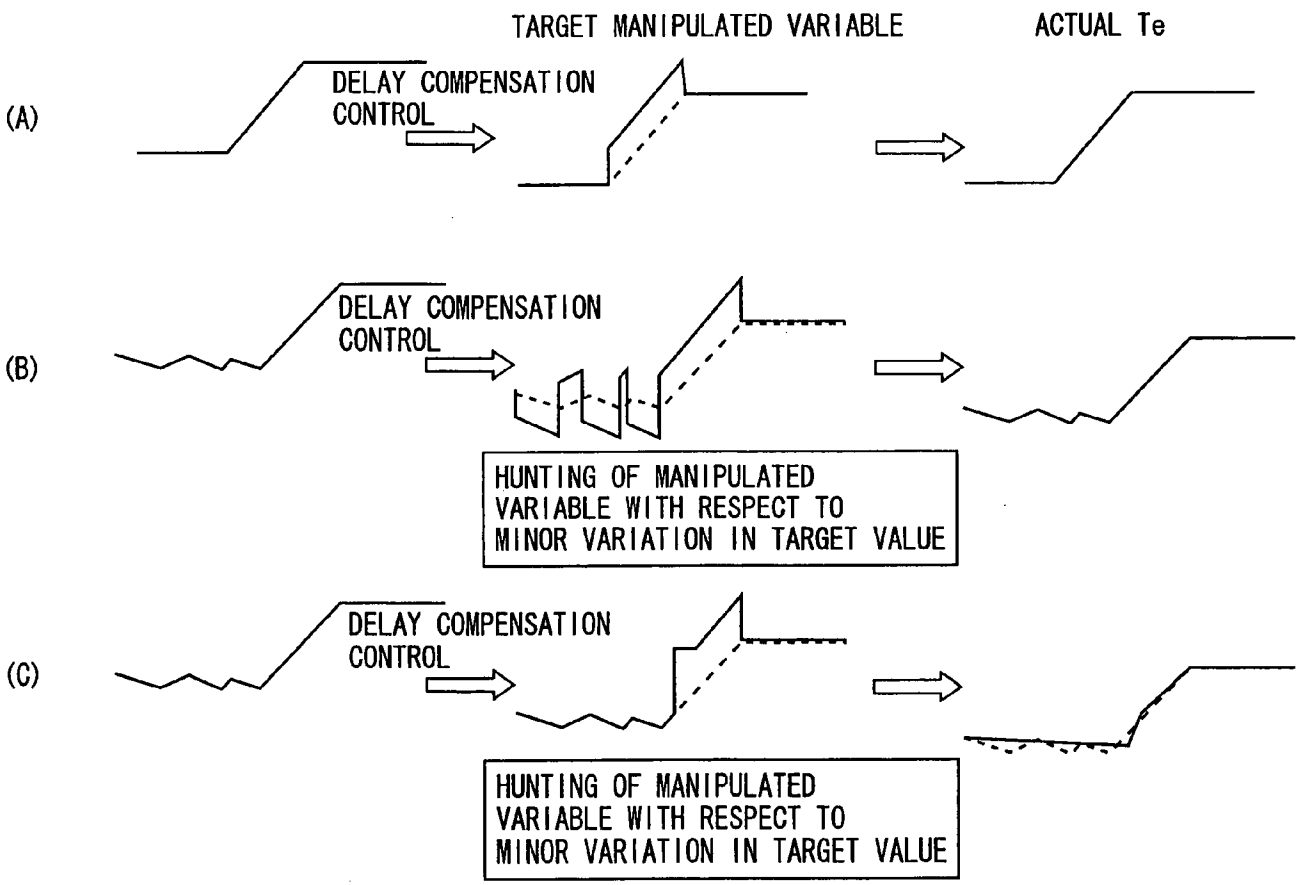
FIG. 11 illustrates a control state in the driving force control system according to the third embodiment of the present invention.

An operation based on the driving force control system according to the present embodiment will be described with reference to FIG. 11.

FIG. 11(A) shows an example where minor variation in the target value does not have to be taken into consideration, FIG. 11(B) shows an example where minor variation in the target value is directly reflected on a manipulated variable in delay compensation control and consequently actual Te becomes unstable due to hunting of the actuator (conventional art), and FIG. 11(C) shows an example where minor variation in the target value is not directly reflected on a manipulated variable in delay compensation control, and consequently hunting of the actuator can be avoided and actual Te does not become unstable (the present embodiment).

As described above, according to the driving force control system of the present embodiment, in carrying out delay compensation (and dead time compensation) control, minor variation in the target value is sensed and whether compensation control is necessary or not is determined. In addition, compensation control is not allowed to follow variation in the target value by providing the dead zone for such variation. Consequently, unnecessary compensation control for unnecessary response characteristic is not performed, and hunting of the actuator can be avoided.

It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

The invention claimed is:

1. A control device for an internal combustion engine, controlling each component in the internal combustion engine based on set target torque, said control device calculating estimated torque generated by said internal combustion engine;

calculating deviation between said estimated torque in consideration of response delay and said target torque;

calculating a torque controlled variable for which response delay has been compensated for, based on calculated said deviation; and controlling each said component by generating an instruction value to each said component based on calculated said torque controlled variable; and in control of each said component, carrying out feedback control such that said deviation is corrected to become greater as response delay is greater.

2. The control device for an internal combustion engine according to claim 1, wherein in calculating said estimated torque, the estimated torque is calculated by using a model equation formulated to include response delay in said internal combustion engine.

3. The control device for an internal combustion engine according to claim 2, wherein in calculating said torque controlled variable, said torque controlled variable is calculated by adding a value obtained as a result of operation of said calculated deviation and a coefficient to said target torque, and said control device changes said coefficient based on an operation condition of said internal combustion engine.

4. The control device for an internal combustion engine according to claim 3, wherein in changing said coefficient, said coefficient is changed to include a dead time in said internal combustion engine.

5. The control device for an internal combustion engine according to claim 3, wherein in changing said coefficient, an operation condition of said internal combustion engine is estimated based on a dead time in said internal combustion engine and said coefficient is changed based on the estimated operation condition of the internal combustion engine.

6. The control device for an internal combustion engine according to claim 3, wherein in changing said coefficient, said coefficient is changed based on a speed and an intake air amount of said internal combustion engine.

7. The control device for an internal combustion engine according to claim 1, wherein said control device prohibits calculation of said torque controlled variable when said calculated deviation is within a predetermined range.

8. The control device for an internal combustion engine according to claim 1, wherein said control device calculates an amount of change in said target torque, and prohibits calculation of said torque controlled variable when said calculated amount of change in said target torque is within a predetermined range.

9. The control device for an internal combustion engine according to claim 1, wherein said control device calculates an amount of change in said target torque, and prohibits calculation of said torque controlled variable when increase in said target torque is reversed to decrease or vice versa and said amount of change in said target torque is within a predetermined range.

10. The control device for an internal combustion engine according to claim 9, wherein said control device holds the torque controlled variable calculated most recently when calculation of said torque controlled variable is prohibited.

11. A control device for an internal combustion engine, controlling each component in the internal combustion engine based on set target torque, comprising:

estimation means for estimating torque generated by said internal combustion engine;

deviation calculation means for calculating deviation between estimated torque in consideration of response delay by using the estimated torque calculated by said estimation means and said target torque;

controlled variable calculation means for calculating a torque controlled variable for which response delay has been compensated for, based on the deviation calculated by said deviation calculation means; and control means for controlling each said component by generating an instruction value to each said component based on the torque controlled variable calculated by said controlled variable calculation means, and said control means carrying out feedback control such that said deviation is corrected to become greater as response delay is greater.

12. The control device for an internal combustion engine according to claim 11, wherein said estimation means includes means for estimating torque by using a model equation formulated to include response delay in said internal combustion engine.

13. The control device for an internal combustion engine according to claim 12, wherein said controlled variable calculation means includes means for calculating said torque controlled variable by adding a value obtained as a result of operation of the deviation calculated by said deviation calculation means and a coefficient to said target torque, and said control device further comprises changing means for changing said coefficient based on an operation condition of said internal combustion engine.

14. The control device for an internal combustion engine according to claim 13, wherein said changing means includes means for changing said coefficient to include a dead time in said internal combustion engine.

15. The control device for an internal combustion engine according to claim 13, wherein said changing means includes means for estimating an operation condition of said internal combustion engine based on a dead time in said internal combustion engine and changing said coefficient based on the estimated operation condition of the internal combustion engine.

16. The control device for an internal combustion engine according to claim 13, wherein said changing means includes means for changing said coefficient based on a speed and an intake air amount of said internal combustion engine.

17. The control device for an internal combustion engine according to claim 11, further comprising prohibition means for prohibiting calculation of said controlled variable by said controlled variable calculation means when the deviation calculated by said deviation calculation means is within a predetermined range.

18. The control device for an internal combustion engine according to claim 11, further comprising:

amount-of-change calculation means for calculating an amount of change in said target torque; and prohibition means for prohibiting calculation of said controlled variable by said controlled variable calculation means when the amount of change in said target torque calculated by said amount-of-change calculation means is within a predetermined range.

19. The control device for an internal combustion engine according to claim 11, further comprising:

amount-of-change calculation means for calculating an amount of change in said target torque; and prohibition means for prohibiting calculation of said controlled variable by said controlled variable calculation means when increase in said target torque sensed by said amount-of-change calculation means is reversed to decrease or vice versa and said amount of change in said target torque is within a predetermined range.

20. The control device for an internal combustion engine according to claim 19, further comprising means for holding the controlled variable calculated most recently when calculation of said controlled variable is prohibited by said prohibition means.

21. A control device for an internal combustion engine, controlling each component in the internal combustion engine based on set target torque, said control device calculating estimated torque generated by said internal combustion engine;

calculating deviation between estimated torque in consideration of response delay and said target torque;

calculating a torque controlled variable for which response delay has been compensated for, based on calculated said deviation;

controlling each said component by generating an instruction value to each said component based on calculated said torque controlled variable; and in control of each said component, carrying out feedback control such that response delay after lapse of a dead time in said internal combustion engine is expected and said deviation is corrected to become greater as the response delay is greater.

22. A control device for an internal combustion engine, controlling each component in the internal combustion engine based on set target torque, comprising:

estimation means for estimating torque generated by said internal combustion engine;

deviation calculation means for calculating deviation between estimated torque in consideration of response delay by using the estimated torque calculated by said estimation means and said target torque;

controlled variable calculation means for calculating a torque controlled variable for which response delay has been compensated for, based on the deviation calculated.

* * * * *